United States Patent [19]

Dufort

[11] 4,165,692

[45] Aug. 28, 1979

[54] FRANGIBLE PROJECTILE FOR GUNNERY PRACTICE

[75] Inventor: Robert H. Dufort, Kenmore, N.Y.

[73] Assignee: Calspan Corporation, Buffalo, N.Y.

[21] Appl. No.: 844,752

[22] Filed: Oct. 25, 1977

[51] Int. Cl.[2] ..... F42B 13/20

[52] U.S. Cl. ..... 102/92.7

[58] Field of Search ..... 102/41, 92.7

[56] References Cited

FOREIGN PATENT DOCUMENTS 261448 4/1968 Austria ..... 102/92.7

1442072 7/1976 United Kingdom ..... 102/92.7

*Primary Examiner*—Verlin R. Pendegrass

*Attorney, Agent, or Firm*—Allen J. Jaffe; David J. Zobkiw

[57] ABSTRACT

A sintered projectile having the same ballistic characteristics as a conventional combat projectile is provided with controlled strength properties and predetermined breakage lines. As a result, small, high drag fragments are produced on impact which minimizes ricochet hazards and provides a safer practice round.

4 Claims, 1 Drawing Figure

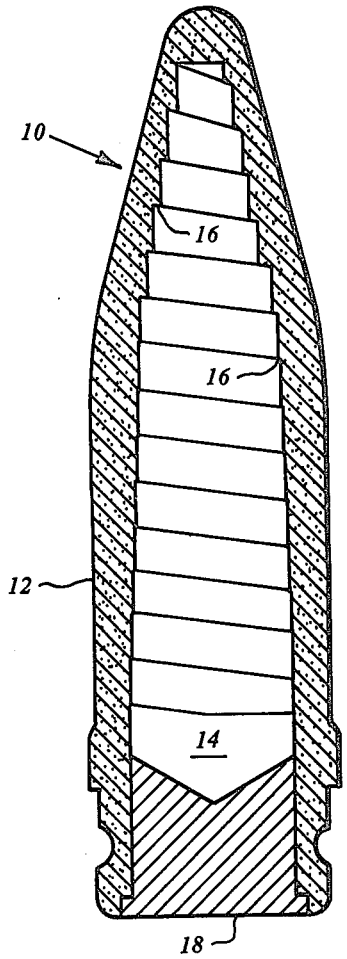
10
16
16
12
14
18

FRANGIBLE PROJECTILE FOR GUNNERY PRACTICE

Low cost air-to-ground practice training rounds are fired at paper/cloth targets for accuracy scoring as distinguished from combat rounds which also create battlefield psychological conditions. To be useful in training, these air-to-ground practice training rounds must reasonably duplicate the ballistics of the simulated combat round in weight, location of the center of gravity, spin inertia and transverse inertia without increasing their cost. Upon impact, it is desirable that ricochet hazards be minimized.

Ricochets can be suppressed by achieving breakup at impact. High drag fragments having a greatly reduced lethal range are needed as distinguished from high lethality fragments for combat rounds. Ricochet hazards are limited to high energy (mass and velocity) projectiles in contrast to small arms low energy projectiles. Achieving fragmentation by internal explosives is not practical. Because many rounds are fired in practice sorties, some projectiles malfunction creating duds (nonexploded projectiles) thereby creating an "instant mine field" in the target impact area.

It is an object of this invention to provide a practice projectile which upon impact breaks into small fragments which will not travel far from the impact point.

It is an object of this invention to provide a practice projectile which is a ballistically valid substitute for high-energy, gun-fired projectiles.

It is a further object of this invention to provide a practice projectile which is non hazardous in the impact area after impact.

It is an additional object of this invention to provide a practice round which is structurally sound at firing and in flight.

It is a further object of this invention to provide projectiles having round-to-round repeatable performance.

It is a still further object of this invention to provide a low cost, reliable practice projectile. These objects, and others as will become apparent hereinafter, are accomplished by the present invention.

Basically, the present invention achieves breakup of the practice projectile through the use of the kinetic energy of the projectile at impact. A delicate balance of structural strength is needed since: (1) the unit must survive the gigh axial accelerating forces and high angular spin-up accelerations occurring in the barrel; (2) the aerodynamic loadings and high ram temperature must not cause failures in free flight, especially near the delivery aircraft, since the fragments could be ingested by the engine(s); and, (3) the nature of applied loadings at impact (i.e. transverse bending, deceleration, etc.) must be exploited by design to achieve breakup.

BRIEF DESCRIPTION OF THE DRAWING

For a fuller understanding of the present invention, reference should now be had to the following detailed description thereof taken in conjunction with the accompanying drawing wherein:

The FIGURE is a sectional view of a frangible projectile.

DESCRIPTION OF THE PREFERRED EMBODIMENT

In the FIGURE, the numeral 10 generally designates a frangible practice projectile. Projectile 10 includes a sintered metal casing 12 having a hollow interior defining a chamber 14. The walls of chamber 14 are defined by a tapering axial helix which results in a helical sharp edged stress riser or fault line 16 on the interior of casing 12. The open end of chamber 14 is closed by a plug 18 whose length and density locate the center of gravity as required.

Casing 12 is made of pressed powdered iron although other metals and/or alloys may be used either as a homogeneous mix throughout the casing or distributed mixes may be used to exploit desirable breakup properties. The powdered iron is pressed into a die-set having a spiral core rod in the die set. The pressed powdered iron is removed from the die and sintered in a furnace. As the cavity 14 is a cast of the spiral core rod, it is readily apparent that the taper permits easy withdrawal of the die. The resulting internal spiral provides high axial torque strength for in-barrel spin-up but provides poor bending strength at impact. The sharp edged stress riser 16 will cause fracture into small fragments having high drag thus reducing ricochet hazards.

The sintering process employed results in brittle properties for the casing 12. These brittle properties can be achieved by means of a higher carbon content, a lowered sintering temperature, a shortened sintering time or a combination of these factors.

In use, the projectile 10 will be the ballistic equivalent of a combat round, a 20 mm round for example, but upon impact, fragmentation will occur along the stress riser 16 causing fracture into small fragments having high drag. This is the result of an inherent circumferential stress in the projectile 10 due to the residual spin at the time of impact. When the projectile 10 breaks up a helical or spiral continuous strip is created initially along the stress riser or fault line 176. The circumferential stress causes an expansion in diameter breaking off segments of the strip into irregular fragments. Iron sintered at 1900°–2050° F. has the desired brittle properties.

Other internal shapes and/or scored configurations are possible to exploit the stress loading differences in the barrel over those at impact. Although the description has been in terms of a practice round, the principles can be applied to a fragmentation combat round. Also, a tungsten carbide nose portion can be provided for armor piercing purposes.

Although a preferred embodiment of the present invention has been illustrated and described, other changes will occur to those skilled in the art. It is therefore intended that the scope of the present invention is to be limited only by the scope of the appended claims.

I claim:

1. A frangible projectile including:

a brittle, sintered metal casing;

a cavity formed in said casing; and an axially extendig sharp edged stress riser formed in said casing and forming at least a portion of the walls of said cavity whereby, upon impact, said casing will fracture along said stress riser.

2. A frangible practice projectile having similar ballistic characteristics to a corresponding combat round and including:

a brittle, sintered metal casing having the dimensions, weight, center of gravity, spin inertia and transverse inertia of the corresponding combat round;

an axially extending cavity formed in said casing; and an axially extending sharp edged stress riser formed in the interior of said casing and forming at least a portion of the walls of said cavity whereby, upon impact, said casing will fracture along said stress riser.

3. A frangible projectile including:

a brittle, sintered metal casing;

a cavity formed in said casing; and sharp edged stress riser in the form of a tapering axial helix formed in said casing and forming at least a portion of the walls of said cavity whereby, upon impact, said casing will fracture along said stress riser and break into relatively small fragments having high drag.

4. A frangible practice projectile having similar ballistic characteristics to a corresponding combat round and including:

a brittle, sintered metal casing having the dimensions, weight, center of gravity, spin inertia and transverse inertia of the corresponding combat round;

an axially extending cavity formed in said casing; and sharp edged stress riser in the form of a tapering axial helix formed in the interior of said casing and forming at least a portion of the walls of said cavity whereby, upon impact, said casing will fracture along said stress riser into relatively small fragments having high drag.

* * * * *